United States Patent [19]

Kossatz et al.

[11] Patent Number: 4,923,664

[45] Date of Patent: May 8, 1990

[54] PROCESS FOR MANUFACTURING A BUILDING PANEL

[75] Inventors: Gert Kossatz, Braunschweig; Wolfgang Heine, Osterode/Harz; Karsten Lempfer; Heinz Sattler, both of Braunschweig, all of Fed. Rep. of Germany

[73] Assignee: Fraunhofer Gesellschaft zur Forderung der Angewandten Forschung E.V., Munich, Fed. Rep. of Germany

[21] Appl. No.: 195,642

[22] Filed: May 18, 1988

Related U.S. Application Data

[62] Division of Ser. No. 88,430, Aug. 24, 1987, abandoned.

[30] Foreign Application Priority Data

Aug. 28, 1986 [DE] Fed. Rep. of Germany ..... 3629223

[51] Int. Cl.[5] ..... B28B 1/16; E04B 5/04; E04C 2/04

[52] U.S. Cl. ..... 264/256; 52/600; 264/DIG. 57

[58] Field of Search ..... 264/256, 255, DIG. 57; 156/307.3, 307.4, 307.7, 242; 428/326; 52/600, 601, 612, 309.17

[56] References Cited

U.S. PATENT DOCUMENTS

| | | | |
|---|---|---|---|
| 513,710 | 1/1894 | Mowry | 52/612 |
| 957,144 | 5/1910 | Bye et al. | 52/600 |
| 1,439,954 | 12/1922 | Emerson | 52/600 |
| 2,220,349 | 11/1940 | Plumb | 52/600 |
| 2,268,965 | 1/1942 | Schumann | 264/256 X |
| 2,305,126 | 12/1942 | Wohl | 264/256 |
| 2,522,116 | 9/1950 | Hayes | 52/612 |
| 3,284,980 | 11/1966 | Dinkel | 52/600 |
| 3,565,650 | 2/1971 | Cordon | 264/255 X |
| 3,574,801 | 4/1971 | Jauker | 264/256 X |
| 3,808,085 | 4/1974 | Givens, Jr. | 52/600 |
| 3,882,215 | 5/1975 | Dyke et al. | 264/255 X |
| 4,185,837 | 1/1980 | Robinson | 264/256 X |
| 4,328,178 | 5/1982 | Kossatz | 264/256 X |
| 4,450,128 | 5/1984 | Takeuchi | 264/256 X |
| 4,708,910 | 11/1987 | Forss | 264/123 |

FOREIGN PATENT DOCUMENTS

| | | | |
|---|---|---|---|
| 138616 | 9/1950 | Australia | 52/612 |
| 469822 | 5/1950 | Canada | 52/600 |
| 1112328 | 3/1956 | France | 52/612 |
| 497561 | 12/1938 | United Kingdom | 52/612 |
| 561231 | 5/1944 | United Kingdom | 52/612 |

*Primary Examiner*—Jan H. Silbaugh
*Assistant Examiner*—Karen D. Kutach
*Attorney, Agent, or Firm*—Dennison, Meserole, Pollack & Scheiner

[57] ABSTRACT

A process for manufacturing a multilayer building panel in which one layer is a main layer comprising a binder and a reinforcing additive, and another layer contains a binder and a reinforcement such as a mat includes depositing the various layers such that one layer is deposited with an excess of water for hardening, and another with a deficiency, so that the water is caused to migrate between layers and creates a transition layer providing a gradual and continuous transition in composition between the layers.

15 Claims, 5 Drawing Sheets

PROCESS FOR MANUFACTURING A BUILDING PANEL

This is a divisional of application Ser. No. 88,430 filed on 8/24/87, now abandoned.

BACKGROUND OF THE INVENTION

The present invention is concerned with a building panel constructed in layers with good elastomechanical and fire-proof technological characteristics, preferably for use as a double or multiple floor for equipping computer rooms, and with a process of manufacturing it.

The trend for simple construction which may be observed in the building and construction industry is followed by a better technical and economic use of material, especially of the composite construction type, which is increasingly becoming of importance. The main advantage is that different material characteristics, which would not otherwise be combined, are united in one construction element. The most favorable characteristics can be formed for certain areas of use by the corresponding choice of single construction components. If, for example, the tractive force and the fire-resistance are considered, then combined favorable material characteristics can be obtained by means of a combination of pure gypsum with glass fibres in mat form. Such a combination occurs in a process which is already known where glass fibres in mat or textile form in regular distribution are immersed in a wet process in amounts of up to 10 mass-% in pure gypsum, whereby the elastomechanic properties of the pure gypsum panel can be improved by a combination with glass fibres.

The technological development went further to multiple layer panels where each layer was responsible for a part of the function to be fulfilled by the entire panel. There are three separate ways of manufacturing such panels:

- Combinations where the layers are bound to one another by means of an adhesive;
- Combinations where the layers are held together by constructive connection members;
- Combinations where the layers are stuck together by means of construction characteristic adhesion forces.

Adhesive connections display disadvantages due to the embrittlement caused by aging and due to the requirements of joint fitting which could have an effect on the bearing construction parts. In the second process, single pre-prepared layers are screwed together or bound together in some other way. In practice the third connection is preferred.

It is known from DD-PS 47099 that the swelling forces, which take effect in the course of the hydration in glass fibre reinforced gypsum covering layers, can be used for connection with other materials. The principle is based on the fact that liquid to plastic gypsum covering layers, due to their having swollen, shrink in dovetail shaped angled metal fitting frames. Metal and glass reinforced gypsum combine statically whereby the metal frame also takes over the edge protection. If a supporting core, for example honeycomb or latticework constructions, is pressed so deeply into the binding means mixture (in flowing state) of the covering layer that it can have contact with the gypsum, then a connection between these can be obtained. A supporting means layer, pressed so far into a binding means which is in a flowing state that adhesive strength is produced between both layers in the hardened state, is therefore usually used in the manufacturing of multiple layer panels. According to this procedure it is also already known that a gypsum milk-glass fibre layer can be put onto a sheet form and a flake-board then pressed into the gypsum-glass fibre layer which is still in a flowable state. In order to improve the adhesion between the gypsum and the flake-board layer, the upper layer of the flake-board is pre-roughened with coarse sandpaper or is provided with grooves.

In spite of this improvement, the connection between the gypsum layer and the flake-board is still unsatisfactory in that the multiple layer panel tends to lose adhesion at the bordering surface between the flake-board and the gypsum layer. In particular with a conceivable use of a gypsum-glass fibre layer as an intermediate layer, there is a danger that, as a result of the low adhesion characteristic of the gypsum layer, the flake-board layers will no longer adhere to one another if there is a strong elastomechanic requirement.

SUMMARY OF THE INVENTION

It is, therefore an object of the present invention, to provide a multiple layer panel having a secure connection between the single layers and thereby provide a building panel with improved combined material characteristics, in particular with improved elastomechanical characteristics.

To achieve this object, the present invention provides a building panel including a main layer comprising a mixture of hydrated binder and an additive or reinforcing material, and at least one further layer which can be an edge layer, an intermediate layer or a combination of an edge and an intermediate layer. These further layers are relatively thin in comparison to the main layers, and are composed of a hydrated binder and a reinforcement. Preferably, the reinforcements are arranged in the edge area of the edge layer. According to the invention, the formation of a contact surface between the separate layers is suppressed by attaining a connection which is as good as possible between the separate layers of the building panel in the layer construction, this connection being formed by a homogeneous transitional layer between the edge, main and intermediate layers.

According to a preferred embodiment the reinforcement is composed of a fibre-lining which can be composed of woven glass-fibre or glass-fibre fleece material.

A conventional inorganic binder, preferably gypsum or a binder mixture, can serve as the binder of the edge, intermediate and main layers. The additive or reinforcing material, henceforth described as the "reinforcing additive", a porous inorganic or organic material, can be included, suitable for taking up, storing and releasing of the mixing water which is required for bonding the binding means. Water soaked particles made of wood shavings, small scraps of paper, wood or waste paper fibres, wood fibre granules, bark particles or similar organic materials are especially suited for this. Especially good construction material characteristics are obtained with this gypsum bound flake-board as a main layer. Useful reinforcing additives include aerated cement particles, expanded clay or expanded mica particles, foam or volcanic (natural) glass, and artificial foam flakes; vermiculite and perlite are preferred. These reinforcing materials can also contain the mixing water necessary for rehydration and shaping. Furthermore, dehydrated grains with a grain size of approximately 1 to 5 mm which function as a crystallization seed may be added.

According to a preferred embodiment, a binding means mixture of sulfatic, lime providing and pozzolanic substances is used as the binding means of the edge, intermediate and/or main layer in order to increase the strength, as is disclosed in DE-OS 3 230 406. This binding means mixture comprises of 50 to 90 weight % lime providing substances and 5 to 35 weight % highly active alumino-silicate pozzolanic substances which are rich in aluminate. The improvement in strength due to the choice of the binding means is particularly to be explained by the fact that the pozzolanic components include a substantial proportion of active clay earth, as is the case with volcanic rock, many brown coal dusts, several metallurgical slags etc. Apart from the calcium sulphate - dihydrate, a further product of the reaction with the co-participation of calcium sulphate-semihydrate, namely tricalcium aluminate-trisulphate hydrate (ettringite), is formed, which contributes considerably to the increase in the strength. The total hardening process of the binding means mixture is determined by this reaction. As the ettringite binds a large amount of the hydrate water (30–32 Mol $H_2O$ per Mol ettringite) the course of the reaction is fundamentally linked to an increase in volume. This increase in volume correlates with the quantity of the created ettringite and is dependent on time. The formation of ettringite can, however, lead to a considerable decrease in firmness or even structural destruction instead of an increase in firmness during the hardening period. An increase in firmness is reached if conditions are available in which ettringite can only be created via the solution phase. This, according to a further preferred embodiment, is achieved by the binding means composition being spatialy constant in the hardening period and, therefore, seen to be suitable if after a hardening period of 7 days for a prismatic body, a maximal admissible difference in length of 0.5% is not exceeded, and a convergent course is determined in the graph of the change of length. If this technical rule is not taken into consideration, then a decrease in the firmness of the building panel is to be expected. The formation via a solution phase is in relation to the development of the calcium hydroxide concentration and with the increase in the volume as long as there is a constant supply of gypsum. In order to promote the formation of ettringite solely in the solution phase, the proportion of pozzolanic components in relation to the lime components can be increased. The optimal ratio can be determined by the volume difference behavior of reference samples according to the previously described preferred embodiment.

According to the invention, inorganic binders other than sulfatic binders, for example, cement, may be used.

In a process for manufacturing a building panel according to the invention, the reinforcing additive is first soaked with water. A mixture of the wet reinforcing additive and binder is deposited on a forming surface, with a large portion of the powdery bonding particles sticking to the wet surfaces of the larger reinforcing additive particles, thereby transferring water. A reinforcement is placed on this deposited layer, and binder in powder form is dusted onto the deposited mixture and reinforcement. The density of the mixture is then increased by applying mechanical action, such as by shaking, rolling or applying low surface pressure. This forces the mixing water out of the reinforcing additive by means of capillary transmission, the water then being passed on to the surrounding binding means and causing a joined gypsum matrix to be formed. The amount of water is sufficient to provide the binder of the edge or intermediate layer with the hydrating water necessary for the hardening phase. Through the increase of the packing density, the border layer zone essential for obtaining the desired binding characteristics, supported by the water transport, is formed between the edge and/or intermediate layers and the main layer.

According to this process, the weight ratio of reinforcing additive to binder in the deposited mixture is about 0.05 to 0.5, preferably 0.185 to 0.2, and the weight ratio of water to binder is about 0.16 to 0.6.

In an alternate process, dried binder and reinforcement are first deposited on the forming surface, such that the reinforcement is embedded in the dry binder powder. There is then sprayed or poured onto the binder and reinforcement a mixture containing binder and reinforcing material which contains sufficient water to harden the binder and to provide a water to binder weight ratio of about 0.3 to 0.6. The density of the sprayed mixture on the forming surface is then increased by mechanical action as described above, to cause the water to pass from the reinforcing material to the binder via contact points, in capillary passages.

When light pressure is applied to densify the mixture, this pressure is generally less than about 1.5 $N/mm^2$.

In this alternate process, it is possible for the amount of water contained in the reinforcing additive to be less than the amount of water necessary for the hardening of the binder in the main layer and the further layer. In this case, the amount of water required for hardening the binder of the further layer can be obtained from the reinforcement embedded in the dry binder, by moistening the reinforcement with water prior to its application.

In a further embodiment of the process, a fluid or pulpy suspension comprising a binder and water can be applied to the forming surface together with the reinforcement which is embedded in the suspension. A mixture of binder and reinforcing additive containing water is then sprayed onto the deposited suspension. The amount of water in the reinforcing material will be less than the amount of water contained in the suspension layer. By mechanical action as described above, the water is caused to pass from the reinforcing additive and the suspension layer into the binder. In this embodiment, either the suspension or the reinforcement can be applied first to the forming surface.

In the various processes according to the invention, it is possible to add to the water additives which are standard in the construction of building panels, such as retarders and accelerators. The additives are generally added in an amount of about 0.01 to 1.0 % by weight of the binder.

It is further possible to combine the various processes for forming the panels by utilizing a panel formed by one process as a forming surface for another process. By combining the processes, and by selecting the number and thickness of the various edge, intermediate and main layers, it is possible to tailor a building panel for specific requirements of bending strength, elastic modulus, gross density, etc.

By using the illustrated semi-dry process according to the invention for manufacturing multiple layer panels, the high expenditure in sealing the shaping apparatus is saved. In the wet process the apparatus must be sealed because a portion of the surplus water overflows during the manufacture of construction components and the apparatus would be soiled. The water utilized in wet technology also burdens effluent water with many gypsum particles. In order to dry the multiple layer panels manufactured in wet technology it is of further importance that a relatively large amount of water remaining in the panel be removed from the gypsum components and this causes high costs as a thermal drying process is generally used. The water which is forced out leaves a correspondingly large pore space in the hardened product through which the density of the material is reduced and the mechanical material characteristics are worsened. In the multiple layer building panel of the invention, semi-dry technology is used so that the water retention ability of porous materials which are added, e.g. expanded clay, perlite, small paper scraps and wood shavings is smaller than their tendency to attract the water of the capillarily porous binding means of the main, intermediate and edge layers. When use is made of this phenomenon according to the invention, it is possible to obtain the water necessary for hydration of the burnt gypsum by means of the semi-dry technology, resulting in a reduction of water surplus of 50 to 70% compared to wet technology.

Thus, a new principle has been discovered which is also the basis for the production of multi-layer panels according to the invention having at least one main layer of, for example, a wood chip-gypsum mixture; the wet wood chips store water, some of which is re-extracted by means of the gypsum binder, and serves as the hardening water necessary for hydration. The wood chips-gypsum mixture which is as damp as soil is automatically spread onto a base and subsequently compressed. As the bending strength of a gypsum-bound flake-board, apart from the additional reinforcing, correlates with its density, increasing compression results in an increased bending strength. In the hardened board, the chips also reinforce the gypsum matrix and interlink, particularly intensively supported by the water transport, with the gypsum of the edge or intermediate layers in a border layer zone between the main layer and the adjacent edge or intermediate layers.

The corresponding processes for the manufacture of the mat or fibre reinforced materials may be carried out either discontinuously or continuously. Suitable processes for depositing the individual layers on what is termed material fleece formation can be of a mechanical as well as of a pneumatic nature.

The formation of a transitional layer which is a gradual and continuous transition from the composition of the main layer to the composition of the edge and/or intermediate layers, described as a homogeneous transition, results in an interlinking of the reinforcing additive of the main layer with the binding means of the edge or intermediate layer. When layers are deposited on already deposited layers, reinforcing additive enters the layer of bonding agent at the edge zone which is promoted by possible subsequent application of slight pressure on the surface or by shaking. A flushing effect of reinforcing additive particles in the lower layers of the main layer can additionally promote the formation of a transitional layer by means of water set free in the upper zones of the main layer.

The subject matter of the present invention results in advantageous improvements of the fire-proof and elastomechanical properties of inorganically bound materials. Furthermore, the formation of an edge layer results in an improved surface finish, e.g. minimized surface roughness and minimized porosity, which in turn may result in enhanced spray water proofing of the inorganically bonded building panel.

BRIEF DESCRIPTION OF THE DRAWINGS

Further details, features and advantages can be seen from the following description of illustrated embodiments.

DESCRIPTION OF THE PREFERRED EMBODIMENTS

Figure 1:
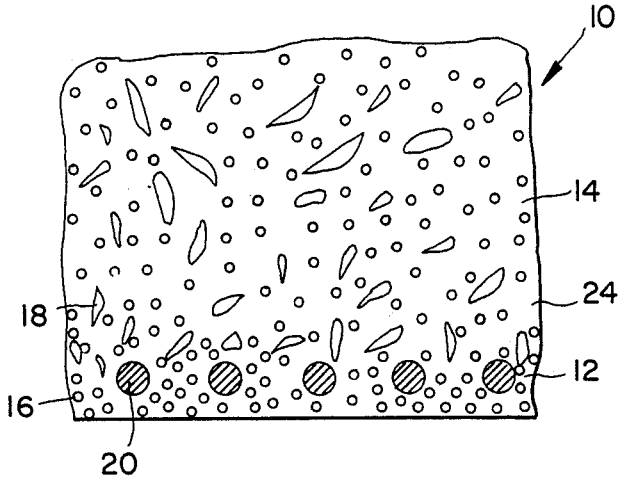
FIG. 1 is a schematic cross-section of a double layer building panel according to the invention, the reinforcement being close to the edge.

The double layer panel 10 according to the invention shown in FIG. 1 comprises an edge layer 12 which is relatively thin compared to the total thickness of the structure and a main layer 14. The edge layer 12 in turn preferably comprises hardened binding particles 16, only some of which are shown in the present FIG. 1. In the binder layer a rough glass fibre mat 20 with surface sealing has been provided as a reinforcement element so that only a thin layer remains between the mat and the surface which consists of binder only. This position is referred to as close to the edge. The main layer comes after edge layer 12 and comprises binder particles 16 and reinforcing additives 18, only some of which are shown in the drawing. An intermediate layer 24 is provided between main layer 14 and the edge layer 12, which, regarding the composition, is a homogeneous transition layer from the binder-reinforcing additive mixture to the edge layer, which, apart from the glass fibre mat with surface coating/sealing, only contains a binding material.

Figure 2:
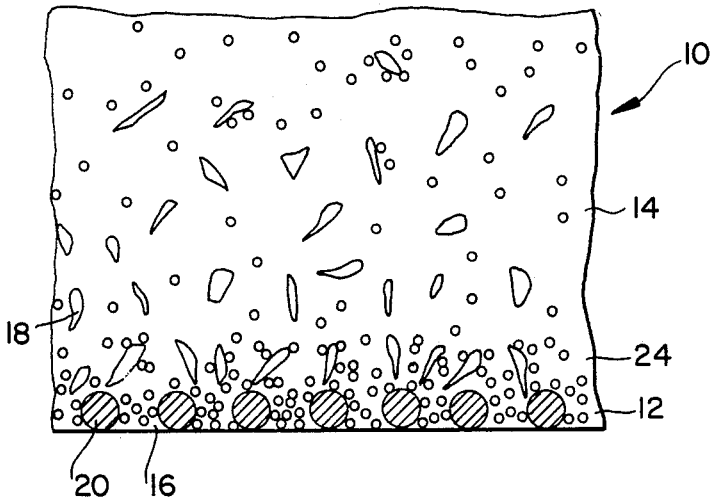
FIG. 2 is a schematic cross-section of a double layer building panel according to the invention, the reinforcement being directly at the edge.

FIG. 2 is a cross-section through a double layer building panel according to the invention, similar to the example of FIG. 1. In this case only the reinforcing fibre layer is provided directly on the edge, which is necessary, for example, when the thickness of the edge layer is minimized.

Figure 3:
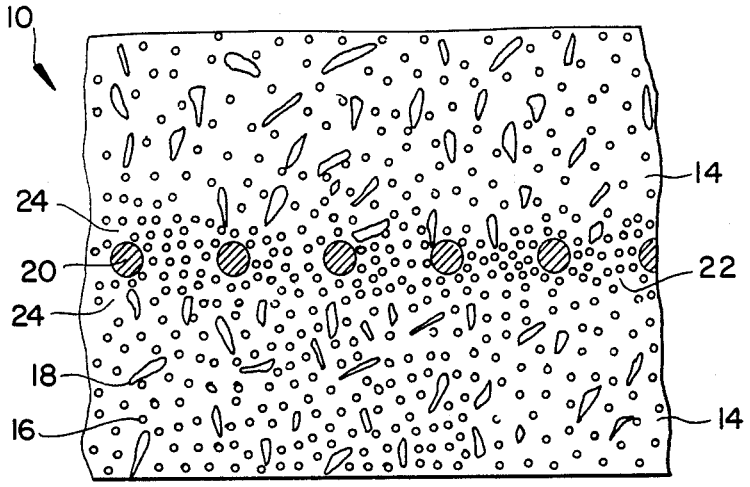
FIG. 3 is a schematic cross-section of a triple-layer building panel according to the invention, the reinforcement being provided in an intermediate layer.

In the embodiment of FIG. 3, two main layers 14 comprising the binder-reinforcing additive mixture and an intermediate layer 22 comprising binder with a coarse glass fibre mat reinforcement 20 are shown.

Figure 4:
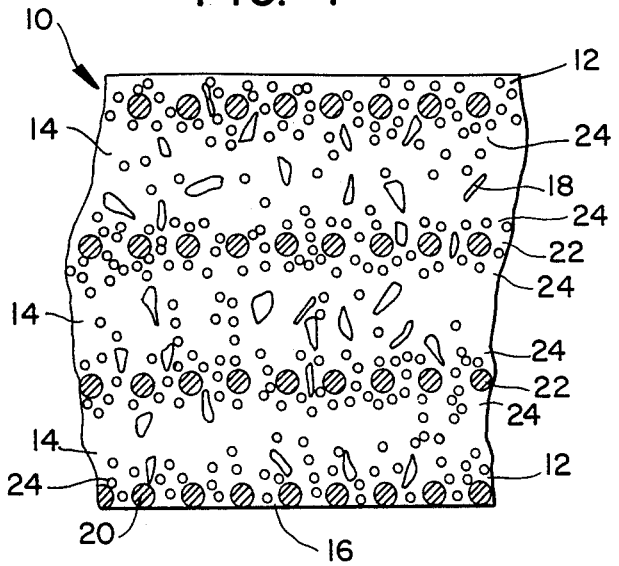
FIG. 4 is a seven-layer building panel according to the invention.

FIG. 4 is a combination of the aforementioned embodiments, which shows a schematic cross-section of a multi-layer building panel comprising two edge layers, two intermediate layers and three main layers. The homogeneous transition zone 24 is formed at all transitions between the edge, the intermediate and the main layers.

Figure 5:
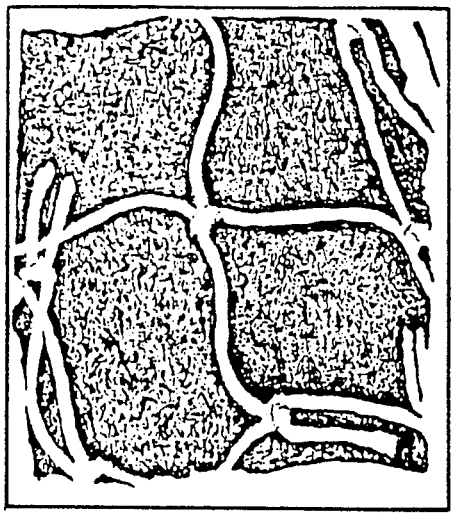
FIGS. 5 to 15 are schematic illustrations of different fibre insert layers which serve as reinforcement.
Figure 6:
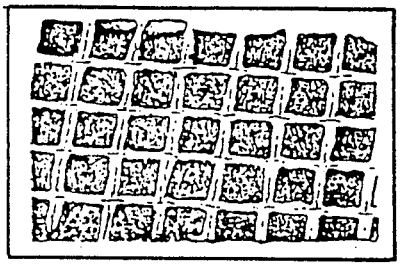
Figure 7:
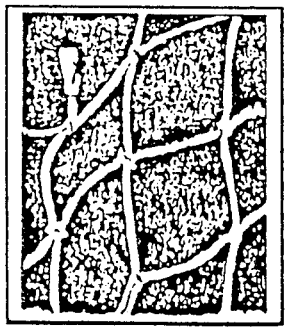
Figure 8:
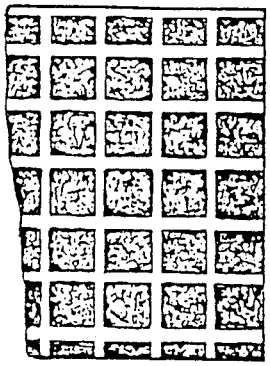
Figure 9:
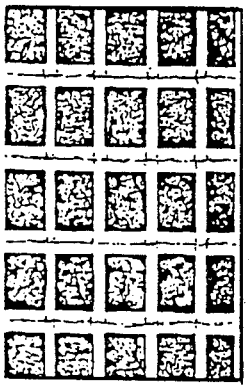
Figure 10:
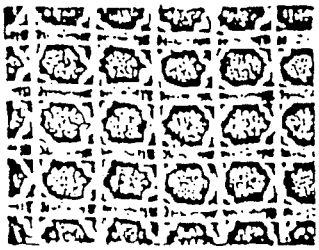
Figure 11:
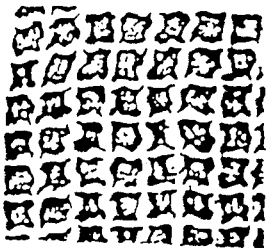
Figure 12:
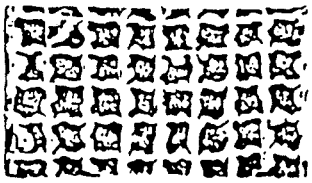
Figure 13:
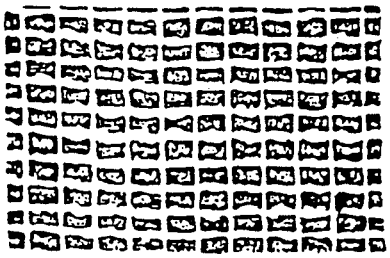
Figure 14:
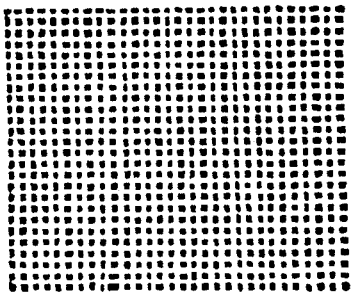
Figure 15:
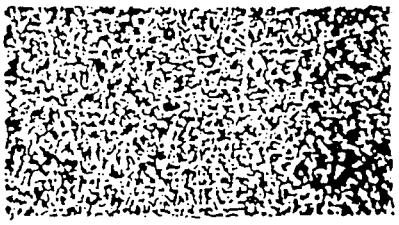

FIGS. 5 to 15 are embodiments of the reinforcements in the edge and/or the intermediate layer. FIG. 5 is a fabric made up of knotted chemical fibres, the meshes having a side length of approximately 44 mm, FIG. 6 is a woven rough glass fibre mat with surface sealing, one side of which is 8 mm and the other is 9 mm, and FIG. 7 is a material made up of coarse chemical fibres, one side of which is approximately 10 mm and the other 11 mm. FIG. 9 is a similar coarse glass fibre mat, having fibres of a larger diameter than those in FIG. 8, FIG. 10 is a fabric of synthetic fibres, the length of one side of which is approximately 10 mm, FIG. 11 is fabric of synthetic fibres, one side of which is 7 mm and the other approximately 6 mm, and FIG. 12 is a similar fabric of synthetic fibres, the fibres of which have a larger diameter than those in FIG. 11. FIG. 13 is a glass fibre mat with side lengths of 6mm×5mm, FIG. 14 is a glass fibre mat with a side length of approximately 2 mm and FIG. 15 is a glass fibre fleece with irregularly disposed glass fibres. Apart from these examples of reinforcements, other glass fibre products, snythetic fibres, organic fibres, and mineral fibre materials can be used.

By means of some examples in which gypsum is used as the binder and wood chips serve as reinforcing additive, the building panel acording to the invention is further explained as follows:

In the following examples, gypsum chip panels are produced in the form of multi-layer panels which have the dimensions 660mm×560mm×38mm. After drying, the reinforcing material-binder weight ratio is $\times=0.25$, the dry density of the gypsum chip panel body reaches a value of $\delta=1200$ kg/m$^3$, and the hydrate water-binder weight ratio is $W=0.16$.

If the semi-dry process is to be used without problems, it is of fundamental importance to provide a homogeneously loose fleece material consisting of additive-binder mixture which does not contain agglomerates and which has free flowing characteristics. This is achieved by soaking the additive or the reinforcing material in a sufficient amount of water and subsequently mixing it with the binder in an appropriate mixing apparatus in the desired ratio. In the present examples, satisfactory results were obtained when a Lodige batch mixer with plowshare and inserted blade was used. The second most important process step is the method used for spreading the additive-binder mixture. Good results were obtained with a two-roller spreading station.

EXAMPLE 1

In a batch process, the wood chip binder mixture prepared as described above is sprayed into a shaping box by means of a two-roller spreading station and a prepared glass fibre mat is put on top of it. Subsequently, gypsum binder is dusted onto the mat by means of a sieve and the wood chip-binder mixture is sprayed on it again. Finally, a slight surface pressure is applied to the panel so that the flushingout effect of the spreading water causes the formation of a transitional layer with a homogeneous transition of the panel component distribution which results in the chips jutting out of the reinforcing mat, thereby increasing the fixing of the mat in the transitional layer between the edge and the main layers. This effect increases as the width of the mesh of the reinforcing mat increases.

The reinforcing additive in the main layer is soaked with enough water that a sufficient amount of hydrating water required for the layer of gypsum is obtained. Consequently, there is a total water-binder ratio of $W=0.35$.

In this example, the gypsum binder is mixed with additives at a weight ratio of $x_z=0.00025$ (based on the weight of gypsum binder) as is common in gypsum technology.

EXAMPLE 2

A moistened glass fibre mat is placed on the bottom of the shaping box. A thin layer of gypsum binder is dusted onto it through a sieve and the main layer of the wood chip mixture prepared as above is sprayed onto it by means of a two-roller spreading station to give a loose material fleece. Due to the required hydration water, the gypsum binder layer extracts surface water from the reinforcing mat and the rest of the water necessary for hardening from the wood-chip binder fleece. During the passage of the water, the desired transitional layer and the resulting inter-linking due to the reinforcing wood chips is obtained. When a slight surface pressure is applied to the settled fleece, the latter is compressed and a reinforcing mat is then put onto the fleece. Subsequently, gypsum binder is dusted onto the mat. Finally, the panel undergoes a last compression stage when a surface pressure is applied to it. The water-binder ratio is $W=0.35$ again. Since a slight surplus of water, relative to the amount of water required for hydration of the binder in the main layer, is added, which is a necessary step from a point of view of process engineering in order to prevent an excess amount of dust during the mechanical spraying of the additive-binder mixture, a disadvantage which is related to this technical advantage, namely that there is an excess amount of water contained in the wood chip-binder mixture, may be compensated by the fact that the excess amount of water serves to bond the binder of the edge layer.

EXAMPLE 3

A glass fibre mat is put on the bottom of the shaping box and a prepared fluid mixture of gypsum binder, water and additive is applied to its surface and uniformly stripped off so as to reduce the amount used. For this slurry the water-binder ratio $W=0.7$ is maintained and the additive ratio selected is $x_z=0.00025$. The wood chip-binder mixture is sprayed onto this layer, whereby a water-binder weight ratio of $W=0.2$ is maintained and consequently no excess water is added to the wood-chip binder fleece. Thus, the formation of pore space during drying, which might reduce the strength of the gypsum matrix, is avoided. In this process water reserves are contained in the outer layers which give off hydration water to the main layer, whereby the desired transitional layer is re-formed when the water passes to the main layer. If the pressure applied for final compression in the above example is increased, a panel of higher density may be produced without difficulty. Increasing the pressure for final compression, however, does not have any consequences for the water passing from the reinforcing materials to the binder but rather has the purpose of decreasing the free pore space which results in an increased panel strength. Thus, for example, a panel produced according to the process of Example 1 which has a dry density of 1,550 kg/m$^3$ will have a bending strength of 18 N/mm$^2$.

What is claimed is:

1. Process for manufacturing a building panel constructed in layers, including a main layer comprising a mixture of hydrated binder and reinforcing additive, and at least one further layer comprising a reinforcement and a hydrated binder, comprising:

(a) soaking a porous reinforcing additive (18) with water, the porous reinforcing additive being capable of taking up, storing and releasing water needed for the hydration of a binder;

(b) mixing the soaked reinforcing additive containing an amount of water needed for hydration of the binder (18) with binder (16) and depositing the mixture on a forming surface, the weight ratio W of water to binder being about 0.16 to 0.6;

(c) placing reinforcement onto the deposited mixture;

(d) dusting further binder (16) in dry powder form onto the deposited mixture and placed reinforcement thereby forming a layer of binder having a deficiency of water needed for hydration of the binder, and increasing the density of the deposited reinforcing additive and binder by mechanical action, whereby the water in the reinforcing additive flows by capillary action to the binder at contact points between the reinforcing additive and the binder resulting in the formation of a coherent matrix by hydration of the binder thereby forming a main layer (14) of hydrated binder and the reinforcing additive, a further layer of hydrated binder and the reinforcement, and a transition layer therebetween the transition layer forming a gradual and continuous transition in composition between the main layer and the further layer.

2. Process according to claim 1, wherein the weight ratio of reinforcing additive to binder in the deposited mixture is about 0.05 to 0.5.

3. Process according to claim 1, wherein the water contains retarders or accelerators in an amount of 0.01 to 1.0 % by weight of the binder.

4. Process according to claim 1, wherein the forming surface is a formed building panel.

5. Process for manufacturing a building panel constructed in layers, including a main layer comprising a mixture of hydrated binder and reinforcing additive, and at least one further layer comprising a reinforcement and a hydrated binder, comprising:

(a) depositing layer of dry binder powder on a forming surface; which layer of binder powder contains a deficiency of water needed for hydration of the binder (b) embedding reinforcement in the dry binder powder;

(c) pouring onto the dry binder powder and the reinforcement a mixture containing binder and a porous reinforcing additive (18) containing water to harden the binder, the porous reinforcing additive being capable of taking up, storing and releasing the water needed for the hydration of the binder;

(d) increasing the density of the poured mixture on the forming surface by mechanical action, to cause the water to pass from the reinforcing additive to the binder through capillary passages via contact points between the reinforcing additive and the binder, thereby hydrating the binder with the water to form a coherent matrix, and forming a main layer of the hydrated binder and the reinforcing additive, a further layer of the hydrated binder and the reinforcement, and a transition layer therebetween, the transition layer forming a gradual and continuous transition in composition between the main layer and the further layer.

6. Process according to claim 5, wherein the mechanical action comprises surface pressure of less than about 1.5 $N/mm^2$.

7. Process according to claim 6, wherein the amount of water contained in the reinforcing additive (18) is less than the amount of water necessary for the hardening of the binder (16) in the main layer (14) and the further layer (12), and the amount of water required for hardening the binder (16) of the further layer (12) is obtained from the reinforcement embedded in the dry binder powder (16) by moistening the reinforcement with water prior to the embedding of the reinforcement.

8. Process according to claim 5, wherein the water to binder weight ratio is about 0.3 to 0.6.

9. Process according to claim 5, wherein the water contains retarders or accelerators in an amount of 0.01 to 1.0 % by weight of the binder.

10. Process according to claim 5, wherein the forming surface is a formed building panel.

11. Process of manufacturing a building panel constructed in layers, including a main layer comprising a mixture of hydrated binder and reinforcing additive, and at least one further layer comprising a reinforcement and a hydrated binder, comprising:

(a) depositing a suspension containing binder and water onto a forming surface;

(b) embedding reinforcement in the suspension;

(c) pouring onto the deposited suspension and embedded reinforcement, a mixture of binder and porous reinforcing additive containing water, the amount of water in the reinforcing additive being less than the amount of water in the suspension, the porous reinforcing additive being capable of taking up, storing and releasing the water needed for the hydration of the binder; and (d) by mechanical action, causing the water in the suspension and reinforcing additive to pass to the binder via contact points between the reinforcing additive and the binder in capillary passages, thereby hydrating the binder with the water, whereby a transition layer is simultaneously formed between a main layer of the hydrated binder and the reinforcing additive and a further layer of the hydrated binder and the reinforcement, the transition layer forming a gradual and continuous transition in composition between the main layer and the further layer thereby forming a coherent matrix.

12. Process according to claim 11, wherein the mechanical action comprises surface pressure of less than about 1.5 $N/mm^2$.

13. Process according to claim 11, wherein the reinforcement is first applied to the forming surface, and the suspension is deposited onto the reinforcement to embed the reinforcement in the suspension.

14. Process according to claim 11, wherein the water contains retarders or accelerators in an amount of 0.01 to 1.0 % by weight of the binder.

15. Process according to claim 11, wherein the forming surface is a formed building panel.

* * * * *